US009121661B2

(12) United States Patent
Calvete

(10) Patent No.: US 9,121,661 B2
(45) Date of Patent: Sep. 1, 2015

(54) INLINE HAMMERLESS PERCUSSION FIRING SYSTEM FOR MUZZLELOADER FIREARMS

(71) Applicant: Ardesa, S.A., Zamudio-Vizcaya (ES)

(72) Inventor: Angel Calvete, Zamudio-Vizcaya (ES)

(73) Assignee: Ardesa, S.A., Zamudio-Vizcaya (ES)

( * ) Notice: Subject to any disclaimer, the term of this patent is extended or adjusted under 35 U.S.C. 154(b) by 0 days.

(21) Appl. No.: 14/069,971

(22) Filed: Nov. 1, 2013

(65) Prior Publication Data

US 2014/0123527 A1 May 8, 2014

Related U.S. Application Data

(60) Provisional application No. 61/721,666, filed on Nov. 2, 2012.

(51) Int. Cl.

| | |
|---|---|
| ***F41A 19/41*** | (2006.01) |
| ***F41A 19/10*** | (2006.01) |
| ***F41C 9/08*** | (2006.01) |
| ***F41A 17/56*** | (2006.01) |
| ***F41A 19/12*** | (2006.01) |
| ***F41A 19/39*** | (2006.01) |

(52) U.S. Cl.

CPC . *F41C 9/08* (2013.01); *F41A 17/56* (2013.01); *F41A 19/10* (2013.01); *F41A 19/12* (2013.01); *F41A 19/39* (2013.01); *F41A 19/41* (2013.01)

(58) Field of Classification Search

CPC ..... F41A 19/39; F41A 19/10; F41A 19/41; F41A 19/54; F41A 19/21; F41A 3/58; F41A 17/50

USPC ..... 42/70.07, 70.06, 70.01, 43, 40, 41, 51, 42/70.04, 70.05, 70.08, 75.04, 8, 44, 45; 89/27.14, 1.3

See application file for complete search history.

(56) References Cited

U.S. PATENT DOCUMENTS

| | | | | |
|---|---|---|---|---|
| 159,170 | A | 1/1875 | Felt | |
| 1,638,351 | A * | 8/1927 | Loomis | 42/70.01 |
| 2,465,432 | A * | 3/1949 | Curci | 42/43 |
| 4,222,191 | A | 9/1980 | Lee et al. | |
| 6,604,311 | B1 | 8/2003 | Laney et al. | |
| 7,621,064 | B2 | 11/2009 | Laney et al. | |
| 7,814,694 | B2 | 10/2010 | Laney et al. | |
| 7,954,269 | B2 | 6/2011 | Laney et al. | |

(Continued)

FOREIGN PATENT DOCUMENTS

| | | | |
|---|---|---|---|
| DE | 1057915 B | * | 5/1959 |
| DE | 1114120 B | | 9/1961 |

(Continued)

*Primary Examiner* — Samir Abdosh
*Assistant Examiner* — John D Cooper
(74) *Attorney, Agent, or Firm* — Robert Curcio; DeLio, Peterson & Curcio, LLC

(57) ABSTRACT

An inline hammerless percussion firing system for muzzleloader firearms with a striker having a firing pin and a striker spring to linearly drive the firing pin forward. A cocking button compresses the striker spring. A pivoting retainer acts against a nut connected to the cocking button to hold the cocking button forward and keep the striker spring compressed. A sear acts to prevent the striker from moving forward until released by a two piece trigger system in which a trigger and trigger edge pivot relative to each other with lost motion before releasing the sear, allowing the trigger edge to move out from below a safety notch in the sear, where firing is prevented, to below a firing notch in the sear to prevent accidental discharges from impact. The cocking button can be released by an uncocking button. Releasing a barrel catch resets firearm to the initial safe position.

17 Claims, 18 Drawing Sheets

(56) References Cited

U.S. PATENT DOCUMENTS

| | | | | |
|---|---|---|---|---|
| 8,096,075 | B2 | 1/2012 | Laney et al. | |
| 2010/0024273 | A1 * | 2/2010 | Duperry et al. | 42/69.01 |
| 2011/0185614 | A1 | 8/2011 | Laney et al. | |

FOREIGN PATENT DOCUMENTS

| | | | | |
|---|---|---|---|---|
| DE | 2622287 Al | | 12/1977 | |
| DE | 4125148 Al | | 2/1993 | |
| DE | 29715238 | * | 10/1997 | F41A 19/00 |
| DE | 29715238 U1 | | 10/1997 | |
| DE | 29715237 U1 | * | 11/1997 | |
| DE | 20219123 U1 | | 4/2003 | |
| EP | 0178284 | | 10/1988 | |
| GB | 01057 A | * | 0/1915 | |
| GB | 191501057 A | | 8/1915 | |
| WO | WO 2012018316 | | 2/2012 | |

* cited by examiner

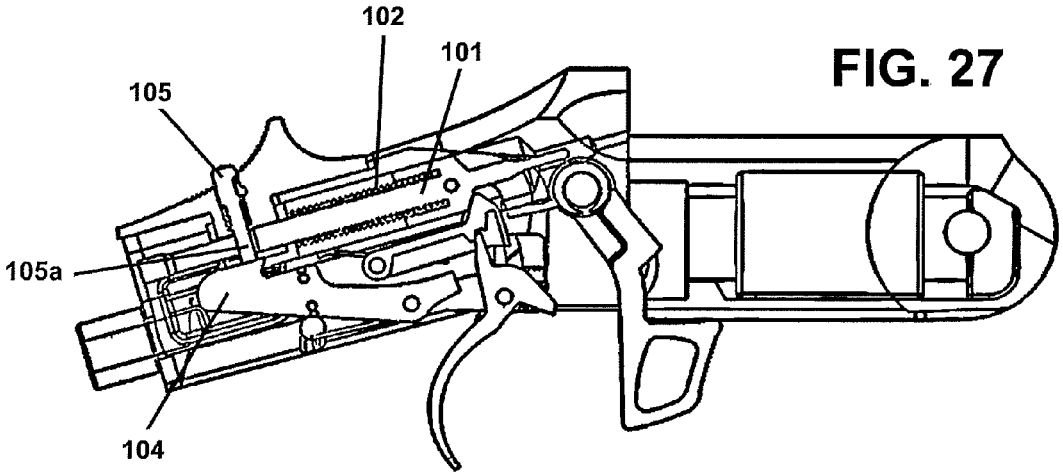
FIG. 27
FIG. 28
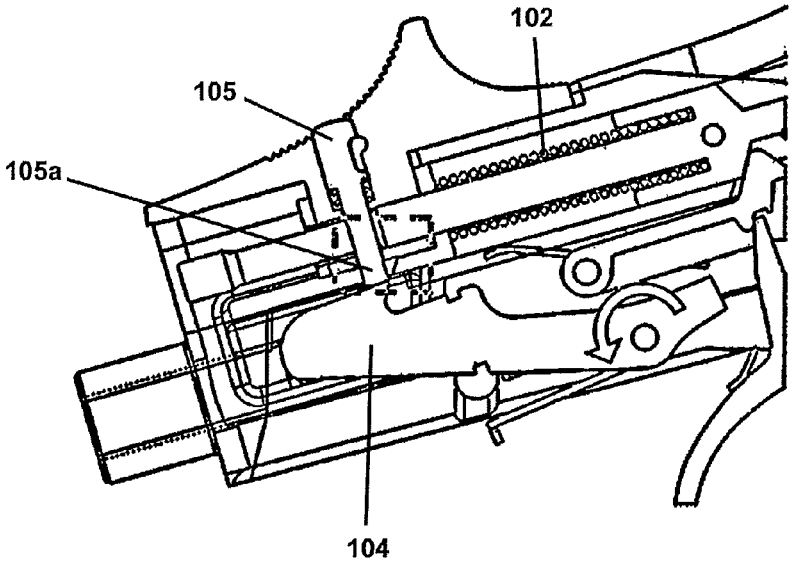

INLINE HAMMERLESS PERCUSSION FIRING SYSTEM FOR MUZZLELOADER FIREARMS

BACKGROUND OF THE INVENTION

1. Field of the Invention

The present invention relates to muzzleloader firearms. More specifically, the present invention relates to an inline hammerless percussion firing system for muzzleloader firearms.

2. Description of Related Art

Muzzleloader firearms have previously been provided with a hammer firing system in which a hammer projects from the rifle and can be pulled back to cock the firearm. A muzzleloader is any firearm into which the projectile and usually the propellant charge is loaded from the muzzle of the gun (i.e., from the forward, open end of the gun's barrel). This is distinct from a breech-loading firearm design.

A hammerless weapon is a modification of the original firing mechanism of firearms. Hammerless firearms do not feature an exposed firing hammer or firing "spur". In rifles, using a firing-pin rather than a hammer reduces the time from trigger pull to firing. This makes the rifle more accurate, because the rifleman's muscular tremors have less time to move the rifle off-aim.

A firearm hammer is easily identifiable in the rear of the weapon's stock and requires the operator to manually "cock" it to arm the weapon. Rifles with an exposed firing hammer are frequently subjected to accidental discharges due to the exposed firing pin. With a hammerless weapon an internal firing pin can reduce the risk of accidental discharge to the operator, because of the safety features of the internal firing pin. Non-muzzleloader firearms subsequently became capable of having a more rapid firing rate as well, because the operator no longer had to manually "cock" the weapon prior to each time the weapon was discharged. These firearms became known as repeating rifles, providing rapid fire over a hammer strike design. However, the benefit of a more rapid firing rate is not realized on a muzzleloader firearm due to the nature of loading a muzzleloader firearm.

Since loading a muzzleloader firearm requires a deliberate sequence, rapid firing is not a consideration. In general, the sequence of loading is to put in gunpowder first, by pouring in a measured amount of loose powder, or by inserting a premeasured bag or paper packet of gunpowder, or by inserting solid propellant pellets. Next, the projectile is pressed into the muzzle. Using a ramrod, the projectile is seated firmly upon the powder charge so that there is no airspace between the projectile and the powder charge. Using a priming tool, the percussion cap is then seated onto the nipple. These actions take time. Thus, rapid fire considerations that would otherwise dictate a hammerless design are counterintuitive to a muzzleloader firearm's inherent operation.

However, there still remains a need to increase the safety of a muzzleloader firearm. It has been experienced that projecting hammers can be caught on bushes, tree limbs, clothing and the like as a muzzleloader firearm is carried, which could lead to the inadvertent cocking of a muzzleloader's hammer type firing system. Covering or bobbing the hammer by removing the spur reduces this tendency, although the risk is not entirely removed. Consequently, it would be advantageous to have a muzzleloader firearm that is hammerless.

SUMMARY OF THE INVENTION

The present invention which is directed to in a first aspect, a muzzleloader firearm inline hammerless percussion firing system comprising: a striker having a firing pin at a forward or breech end; a striker spring for biasing the striker in the forward position when the striker spring is compressed; a cocking button for compressing the striker spring; a retainer holding the cocking button in a forward position and keeping the striker spring compressed; a sear pivotally mounted to the firearm for blocking the striker until a trigger system releases the sear; and the trigger system including a trigger holding the sear in a blocking position and releasing the sear upon movement of the trigger.

The trigger system includes the trigger and a trigger edge, the trigger edge including a top segment in a same vertical plane as a trigger blade, and a lateral trigger segment seated at a lower portion of the top segment and having a width extending laterally outwards from the top segment width, the trigger blade adapted for compression by a shooter's finger, the trigger and the trigger edge being joined by a pivot pin that allows both parts to rotate in mechanical communication with one another, the rotation controlled by tension springs, such that movement of the trigger edge against the trigger by the shooter's compression of the trigger blade is resiliently resisted by the tension springs, and the trigger edge top segment initially moves without moving the trigger establishing an initial lost motion operation.

The trigger system further includes: the lost motion operation wherein the trigger contacts the sear to hold the sear in the blocking position, and the trigger edge pivots relative to the trigger with lost motion before contacting the trigger at the trigger edge lateral segment and moving the trigger to release the sear; and the trigger blade of the trigger edge being movable by a shooter's finger pressure to move the trigger edge top segment from below a safety notch in the sear, where firing is prevented, to below a firing notch in the sear, where firing can occur.

The cocking button includes a cylindrical nut portion having a slanted outer receiving surface or tooth for mechanically securing to a complementary extending segment on the retainer, such that when the cocking button is in the forward position, the complementary extending segment on the retainer holds the cocking button cylindrical nut portion in place, keeping the striker spring compressed.

The trigger includes a rearward facing shelf, and the sear includes a forward lower edge held by the rearward facing shelf of the trigger when the sear is blocking the striker.

The top segment of the trigger edge moves into the firing notch of the sear releasing the sear to drop off a rearward facing shelf of the trigger, such that the top segment of the trigger edge moves past the safety notch of the sear and below the firing notch of the sear to allow the sear to move down and release the striker.

The muzzleloader firearm inline hammerless percussion firing system may further include an uncocking button located proximate the cocking button, the uncocking button when pressed downwards into the firearm, disengages the cylindrical nut portion from the retainer, which in turn drives the striker back by the striker spring.

The muzzleloader firearm inline hammerless percussion firing system may further include a barrel catch having a rearward projection that, when driven rearward contacts a front end of the retainer causing the retainer to tilt about a pivot point, and tilting the retainer front end up, causing the retainer back end to tilt down releasing releases the striker from engagement with the cocking button.

The muzzleloader firearm inline hammerless percussion firing system may further include a trigger pressure regulation screw that adjusts a sear release force, such that upon rotation of the trigger pressure regulation screw, pressure applied by a trigger spring increases or decreases the sear release force.

In a second aspect, the present invention is directed to a muzzleloader firearm inline hammerless percussion firing system comprising: a striker having a firing pin at a forward end; a striker spring connected to the striker to linearly drive the striker and firing pin forward; a cocking button slidably mounted to the firearm, the cocking button is slidable from a rearward safe position to a forward firing position to compress the striker spring and cock the firearm; a retainer pivotally mounted to the firearm acts proximate the rear of the striker to hold the cocking button forward and keep the striker spring compressed; a sear pivotally mounted to the firearm moves from a blocking position in which the striker is prevented from moving forward to a released position, the sear includes a safety notch and a firing notch deeper than the safety notch; and a lost motion trigger system including a trigger that contacts the sear to hold the sear in the blocking position and a trigger edge that pivots relative to the trigger with lost motion before contacting the trigger and moving the trigger to release the sear; the trigger edge is movable by a shooter's finger pressure to move out from below the safety notch in the sear, where firing is prevented, to below the firing notch in the sear, where firing can occur.

In a third aspect, the present invention is directed to a method of firing a muzzleloader having an inline hammerless percussion firing system comprising: cocking the muzzleloader, the cocking including: sliding a cocking button from a rearward safe position to a forward firing position; compressing a striker spring acting on a striker by sliding the cocking button forward; holding the striker spring compressed at a rearward end by pivotally rotating a retainer mounted to the firearm, the retainer acting proximate the rear of the striker to hold the cocking button in the forward firing position, and maintaining compression to the striker spring; holding the striker spring compressed at a forward end by a pivotally mounted sear, the sear rotated to a blocking position, thereby maintaining compression to the striker spring and preventing the striker from moving forward to a released position, the sear including a safety notch and a firing notch deeper than the safety notch; and holding the sear in the blocking position by positioning a trigger to prevent pivotal movement of the sear; releasing the striker, the releasing including: compressing a trigger blade to release the trigger; moving the sear from the blocking position to a release position, thereby allowing the striker to move forward upon force supplied by the compressed striker spring; and moving a firing pin by releasing the striker to move linearly forward under the striker spring force to strike a cartridge.

The method step of compressing the trigger blade to release the trigger may include: rotating a trigger edge in mechanical communication with the trigger through a pivot pin, the rotation controlled by tension springs, such that movement of the trigger edge against the trigger by a shooter's compression of the trigger blade is resiliently resisted by the tension springs, the trigger edge initially moving without moving the trigger, establishing a lost motion operation; and upon contact of the trigger edge with the trigger, moving the trigger away from contact with the sear, releasing the sear from the blocking position.

The method steps may further include turning a trigger pressure regulation screw to adjust a sear release force, such that upon rotation of the trigger pressure regulation screw, pressure applied by a trigger spring increases or decreases the sear release force.

The method may also include releasing a safety on the firearm before the step of releasing the striker, the safety released from a safety lock position to a fire position by pushing a safety pin laterally inwards toward the firearm frame.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 10 through 34 are sequential views showing different aspects of how the invention operates. FIGS. 10 through 23 are sequential views showing the process of firing the rifle. FIGS. 24 through 26 are sequential views showing the process of removing the used primer after the rifle has been fired. FIGS. 27 and 28 are sequential views showing the process of uncocking the rifle after it has been cocked when it is not desired to fire the rifle. FIGS. 29 and 30 are sequential views showing how the rifle is automatically uncocked when the barrel catch is pressed after the rifle has been cocked. FIGS. 31 through 34 are sequential views showing the antidrop safety system that prevents the rifle from accidentally firing if the rifle is dropped. More specifically:

FIGS. 10 and 11 are right side views showing an initial position for the inline hammerless percussion firing system according to the present invention. The firing spring is shown uncompressed and the trigger and sear are shown in fired and safe position. FIG. 10 substantially corresponds to FIG. 8 with external components being shown partially transparent to show internal components. FIG. 11 substantially corresponds to FIG. 9 with the section being taken to show internal components. A detail view is provided with FIG. 11 to better show the trigger and sear in the fired and safe position.

FIGS. 12 and 13 are right side views showing a second position of the inline hammerless percussion firing system according to the present invention. The cocking button has been moved to the right to compress the firing spring. FIG. 13 incorporates a detail view that shows how the firing spring is retained in the compressed position by the retainer.

FIGS. 14 and 15 are perspective views showing the trigger, trigger edge and associated springs of the hammerless percussion firing system according to the present invention.

FIGS. 16, 17, and 18 are right side views showing further sequential positions of the inline hammerless percussion firing system as the rifle is about to be fired. In these views the frame has been removed and the sear and the hammer retention are shown partially transparent to better show the relationship of the illustrated components. In FIG. 16 an arrow shows the direction of pressure applied to the trigger edge to fire the rifle.

In FIG. 17 the bottom end of the trigger edge has moved to the rear and the upper end of the trigger edge has moved forward out of the safe position as finger pressure is applied to the bottom end of the trigger edge to fire the rifle. FIG. 17 also indicates the location of the detail view of FIG. 18. The frame has been removed and the sear and the hammer retention are shown partially transparent to better show the relationship of the illustrated components.

FIGS. 19, 20, and 21 are right side views showing additional sequential positions of the inline hammerless percussion firing system. In FIG. 19 the trigger edge is just about to move the trigger to release the sear and fire the rifle. In FIG. 20 the trigger edge has moved the trigger to release the sear. The top end of the trigger edge has moved past a safe position to allow the sear to move down and release the striker. FIG. 20 also shows the location of the detail view of FIG. 21 which shows, at an increased scale, that the sear has been released by the trigger.

FIGS. 22 and 23 are right side views showing subsequent sequential positions of the inline hammerless percussion firing system. In FIG. 22 the sear has moved down as the striker moves forward under the pressure applied by the striker. In FIG. 23 the striker has been driven fully forward so that the firing pin has impacted the primer to fire the rifle.

FIGS. 24, 25, and 26 are right side views showing further sequential positions of the inline hammerless percussion firing system. In FIG. 24 an arrow indicates how pressure is applied against the barrel catch to release the barrel. In FIG. 25 the barrel catch has moved to release the barrel. The front of the retainer has been tilted up and the back of the retainer has tilted down to release the back of the striker. In FIG. 25 the striker is still forward. In FIG. 26 the striker has moved to the rear and the mechanism has returned to the first position shown in FIG. 10.

FIGS. 27 and 28 are right side views showing sequential positions of the inline hammerless percussion firing system when the striker has been cocked and is ready to fire, but it is not desired to fire the rifle. In FIG. 27 the striker spring is compressed. FIG. 28 shows how the retainer has been moved down by the uncocking button to release the striker to move to the rear so that the striker spring is no longer compressed. An arrow indicates how pressure is applied against the uncocking button to release the retainer.

FIGS. 29 and 30 are right side views showing sequential positions of the emergency uncocking system for the inline hammerless percussion firing system. Emergency uncocking occurs when the striker has been cocked and is ready to fire, and the barrel catch is then pressed. In FIG. 29 the striker spring is compressed. An arrow indicates how pressure is applied against the barrel catch. In FIG. 30, the barrel catch has moved to the rear. This presses up on the front of the retainer, which moves the rear of the retainer down. This releases the striker to move to the rear so that the striker spring is no longer compressed.

FIGS. 31, 32, 33, and 34 are right side views showing sequential positions of the antidrop safety system. In FIG. 31 the striker spring is compressed and the rifle is ready to fire. The trigger edge has not been pressed. In FIG. 32 an impact occurs as the rifle is dropped. In FIG. 33 the trigger edge has not moved because the trigger has not been pulled to the rear to intentionally fire the rifle, but the trigger has been moved off the sear by the impact. In FIG. 33 the sear has moved only partially down, but the striker has not moved forward as the trigger edge is preventing the sear from moving fully down. FIG. 34 shows this in greater detail.

FIG. 35 is a left side view showing the position of the trigger pressure regulation screw. FIG. 36 is a perspective view from the bottom showing the trigger pressure regulation screw. FIG. 37 is a detail view with portions of the rifle shown partially transparent to better show the components of the trigger pressure regulation system.

FIG. 38 demonstrates the position of the safety pin in the SAFETY ON position, while FIG. 39 demonstrates the position of the safety pin in the SAFETY OFF position.

DESCRIPTION OF THE PREFERRED EMBODIMENT(S)

In describing the preferred embodiment of the present invention, reference will be made herein to FIGS. 1-41 of the drawings in which like numerals refer to like features of the invention.

Figure 1:
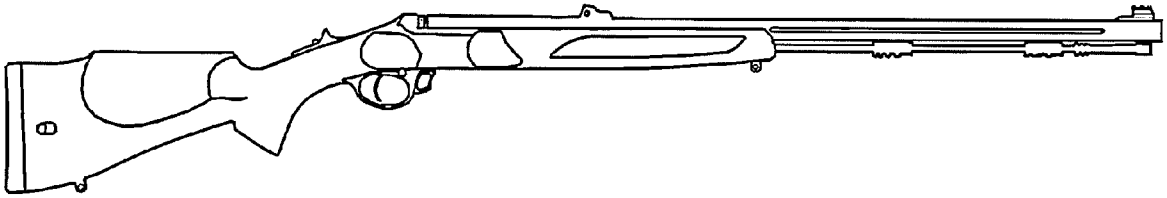
FIG. 1 is a right side elevational view of a muzzleloader rifle incorporating an inline hammerless percussion firing system according to the present invention.
Figure 2:
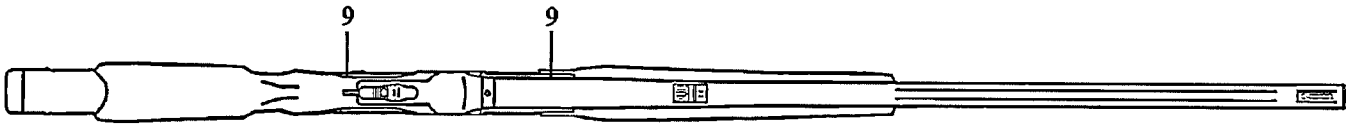
FIG. 2 is a top plan view of the muzzleloader rifle shown in FIG. 1 incorporating an inline hammerless percussion firing system according to the present invention.
Figure 3:
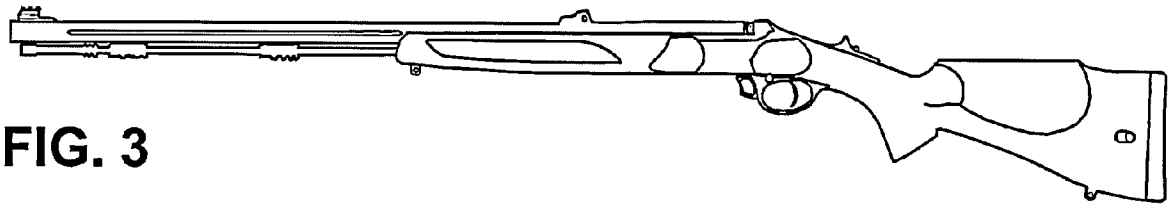
FIG. 3 is a left side elevational view of the muzzleloader rifle shown in FIG. 1 incorporating an inline hammerless percussion firing system according to the present invention.
Figure 4:
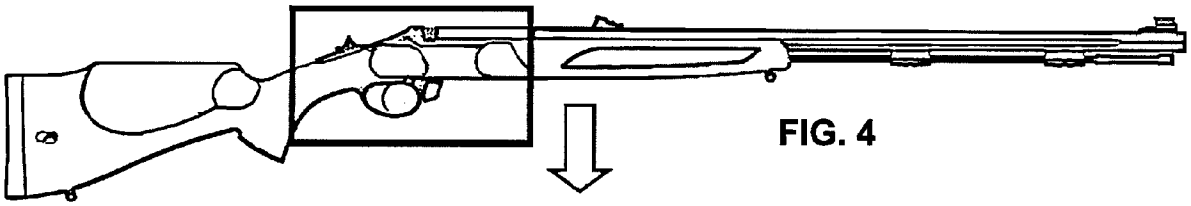
FIG. 4 is a right side elevational view of the muzzleloader rifle shown in FIG. 1 with a detail portion of the inline hammerless percussion firing system indicated with a rectangle.
Figure 5:
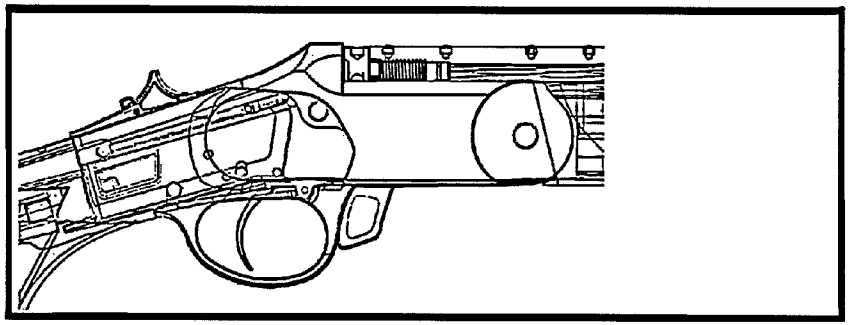
FIG. 5 is a right side view showing the detail portion of FIG. 4 at an increased scale. Portions of the outer components of the muzzleloader rifle have been shown as partially transparent to illustrate internal components of the muzzleloader rifle and the inline hammerless percussion firing system therein.
Figure 6:
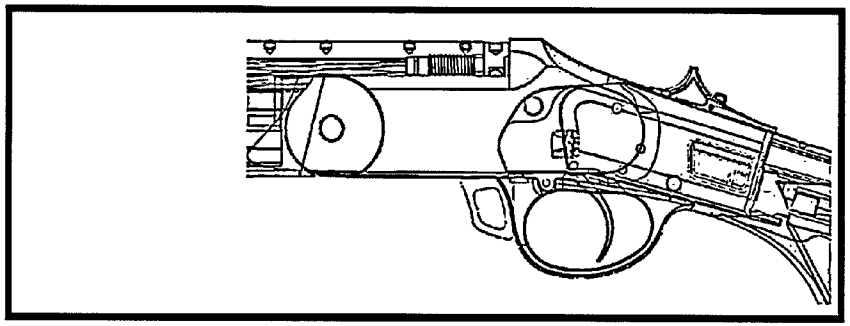
FIG. 6 is a left side view showing the detail portion of FIG. 4 at an increased scale. Portions of the outer components of the muzzleloader rifle have been shown as partially transparent to illustrate internal components of the muzzleloader rifle and the inline hammerless percussion firing system therein.
Figure 7:
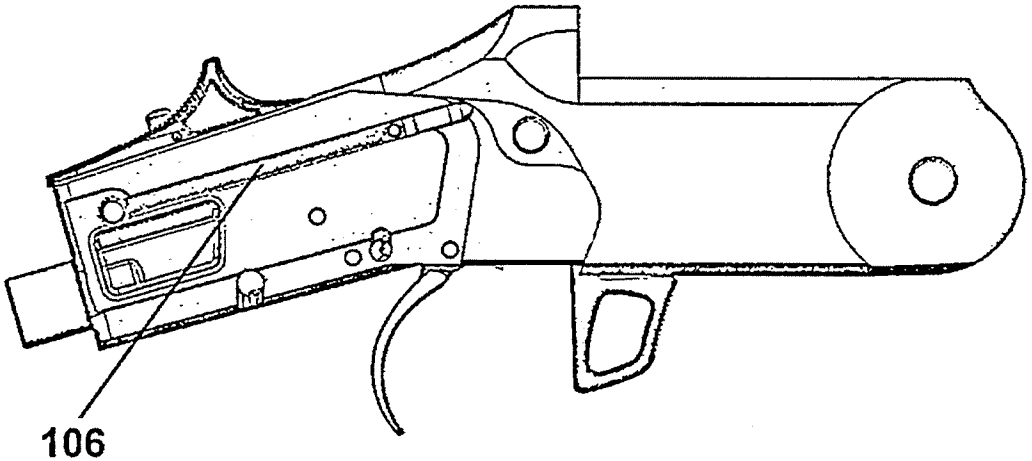
FIG. 7 is a right side view showing the frame of the muzzleloader rifle shown in FIG. 1. The view approximately corresponds to FIG. 5 and the detail portion of FIG. 4 except that only the frame of the rifle and components therein are shown.
Figure 8:
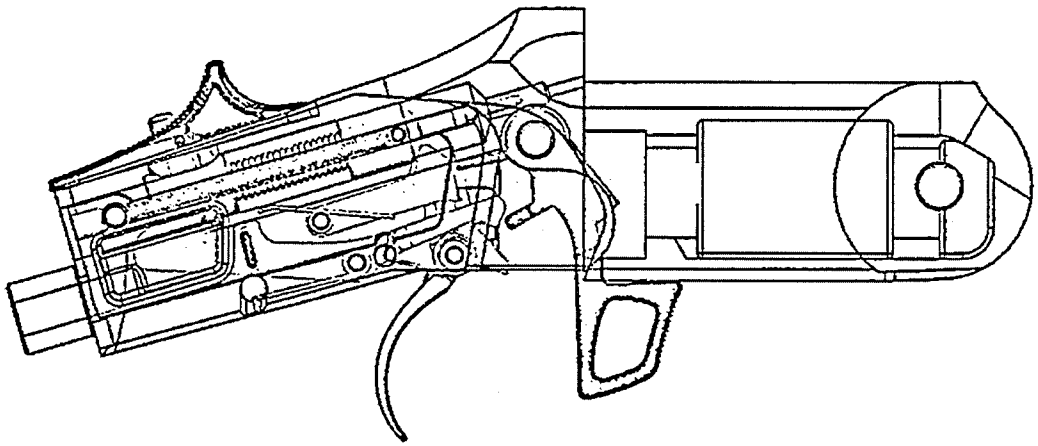
FIG. 8 is a right side view showing the frame of the muzzleloader rifle shown in FIG. 1. The view substantially corresponds to FIG. 7 and the detail portion of FIG. 4. Portions of the outer components of the muzzleloader rifle frame have been shown as partially transparent to illustrate internal components of the muzzleloader rifle and the inline hammerless percussion firing system therein.
Figure 9:
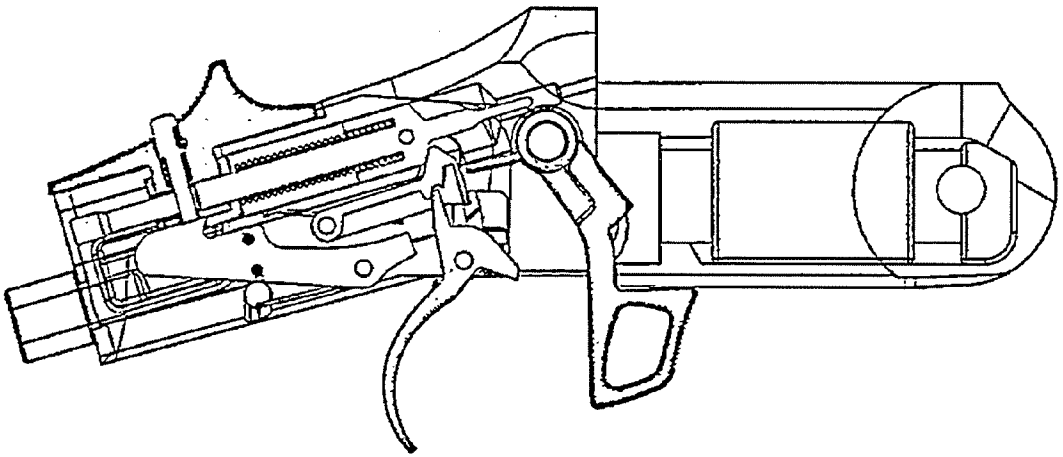
FIG. 9 is a right side cross sectional view through the frame of the muzzleloader rifle along the line 9-9 in FIG. 2. The view approximately corresponds to FIGS. 7, 8 and the detail portion of FIG. 4.
Figure 10:
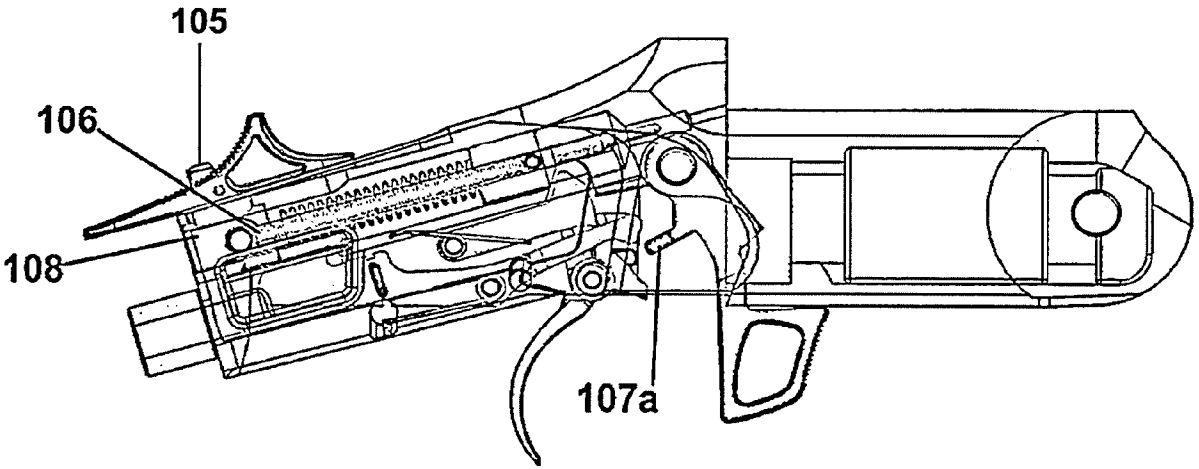
Figure 11:
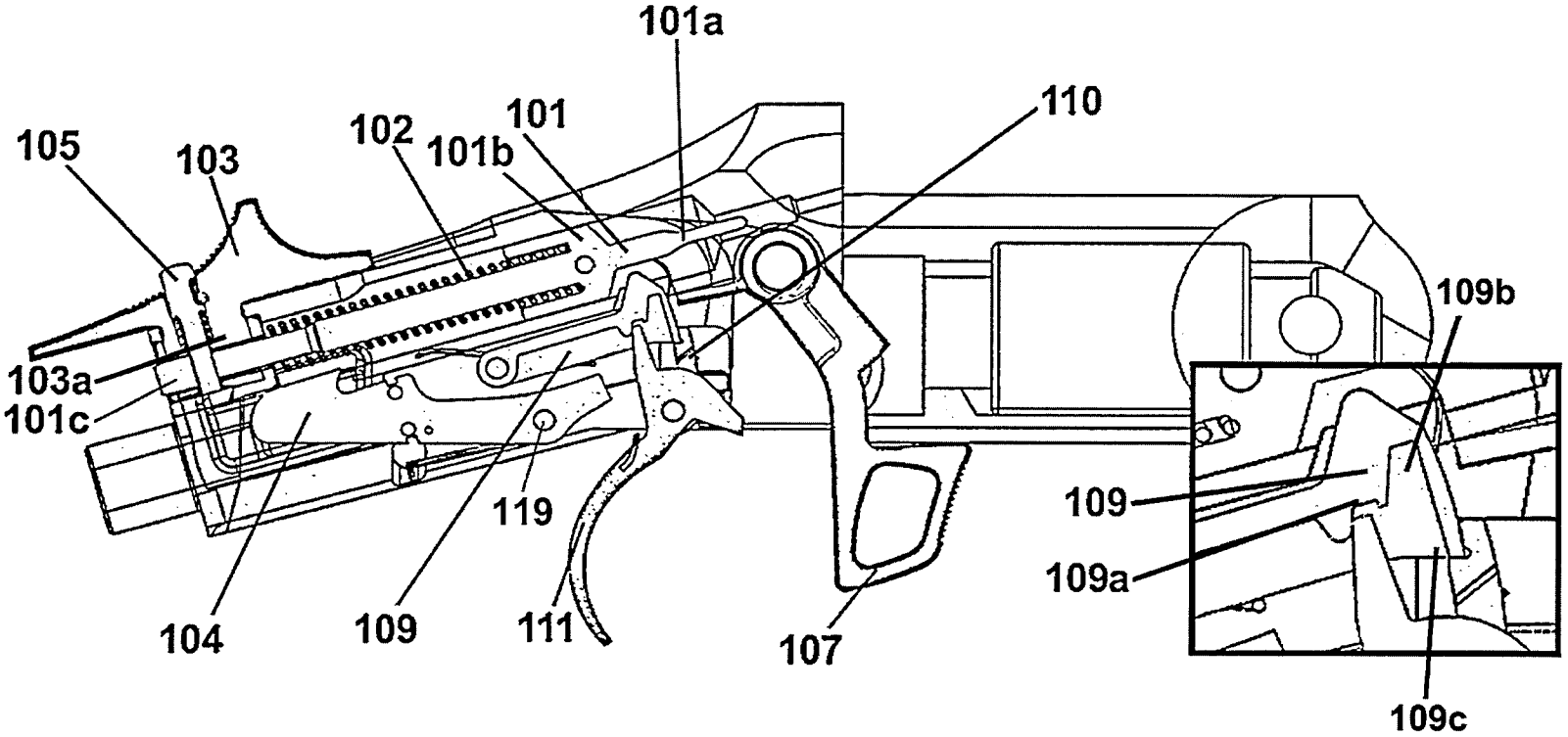

Referring first to FIGS. 1-11 and more specifically to FIGS. 10 and 11, the inline hammerless percussion firing system for a muzzleloader includes a striker 101 that moves linearly within the rifle. The forward end (to the right in FIGS. 10 and 11) of the striker is shaped as a firing pin 101*a* to strike a primer and fire the muzzleloader. Behind the firing pin 101*a* the striker 101 is enlarged at 101*b*.

The striker 101 is surrounded by striker spring 102. The rear end 101*c* (left end in FIGS. 10 and 11) of the striker slides within the bottom end 103*a* of a cocking button 103 and within a nut piece 108 carried by the bottom end 103*a* of the cocking button. The striker spring 102 is trapped between the enlarged portion 101*b* of the striker at the front end and the nut piece 108 on the bottom end 103*a* of the cocking button 103.

In the initial position shown in FIGS. 10 and 11, striker spring 102 is not compressed. Cocking button 103 is at a rearward position. The trigger edge 111 and sear 109 are in the fired and safe position. The retainer 104 and cylindrical nut piece 108 proximate the bottom end 103*a* of the cocking button 103 are not engaged. The barrel catch 107 is forward and engaged with the barrel (not shown here). In this initial position it is not possible to fire the rifle.

Figure 12:
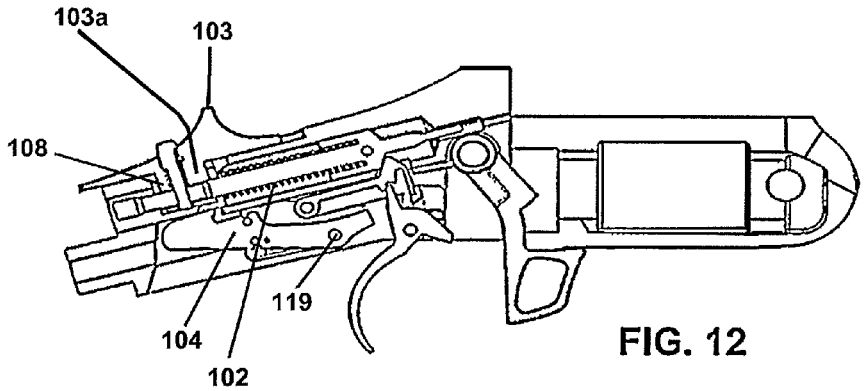

FIG. 12 depicts the striker firing mechanism when forward pressure is applied to the cocking button 103, sliding nut piece 108 and the bottom end 103*a* of the cocking button forward, which in turn compresses striker spring 102. The stored potential energy in the striker spring when the striker spring is compressed is designed to deliver a spring force that is used to drive the striker and firing pin forward to fire the rifle.

Figure 13:
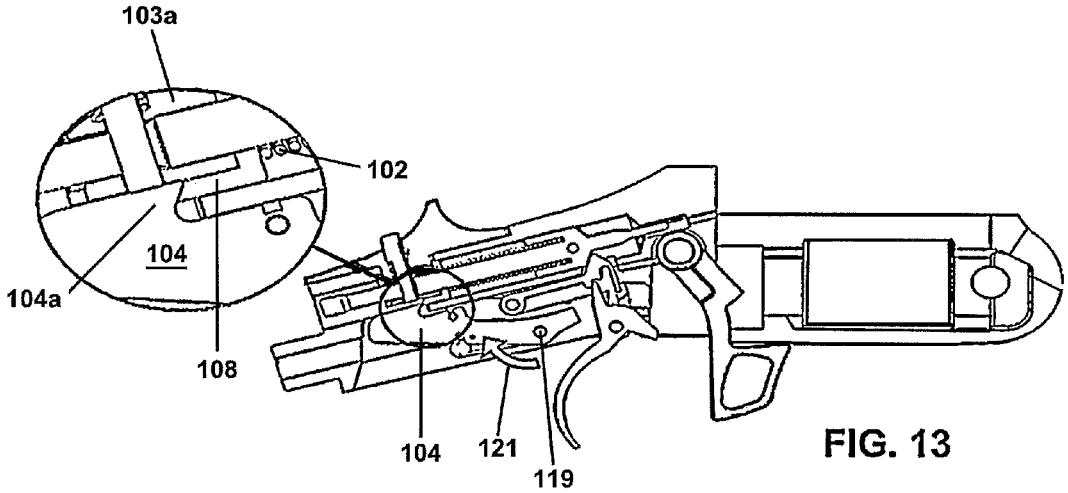

FIG. 13 and the associated expanded detailed view show the firing position reached after the cocking button 103 has moved forward. In this position striker spring 102 is held in the compressed state by the retainer 104, which tilts or pivots about pin 119 in the direction of arrow 121. The rearward end of the retainer 104 is provided with a catch 104*a* that engages nut piece 108 on the bottom end 103*a* of the cocking button 103, as shown in the detail view of FIG. 13. This "locking" action holds striker spring 102 compressed until the rifle is fired or uncocked.

Figure 14:
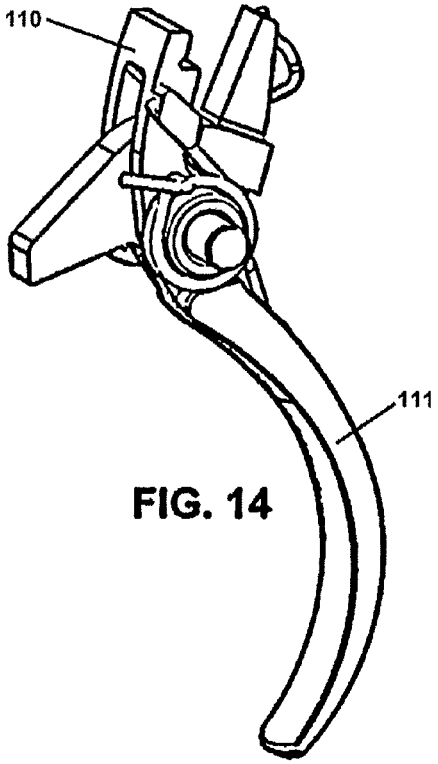
Figure 15:
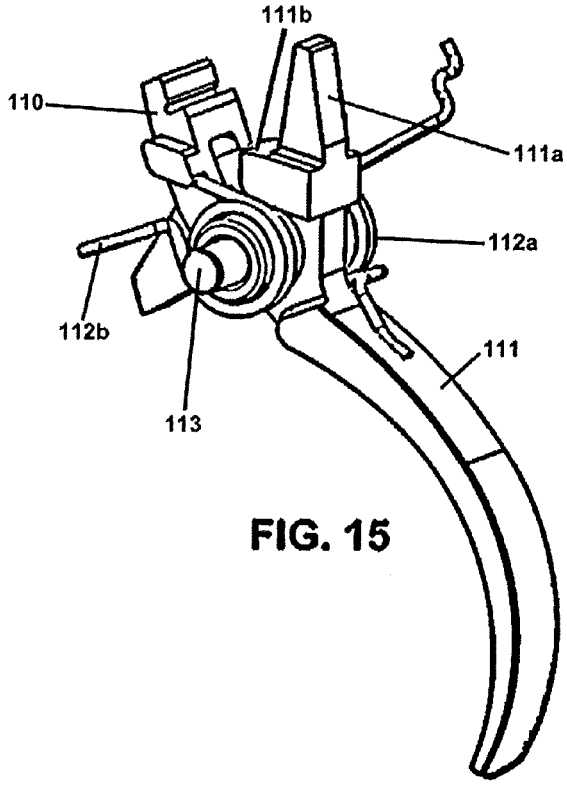

FIGS. 14 and 15 depict the trigger mechanism 111. Trigger mechanism 111 is pivoting mechanism that includes at least two pivotally connected components: trigger 110 and trigger edge or blade 111. Associated springs 112*a,b* pivotally connect trigger edge 111 and trigger 110 with pivot pin 113, one spring 112*a* applies resistive force for the trigger edge 111 and another spring 112*b* applies force to trigger 110. Both components are joined by pivot pin 113 that allows both parts to rotate. Trigger edge 111 includes a top segment 111*a* in the same vertical plane with trigger blade 111, and a lateral trigger segment 111*b* seated at the bottom of top segment 111*a*, and having a width extending laterally outwards from the width of top segment 111*a*. When the bottom end of trigger edge 111 is pulled by the shooter's finger (to fire the rifle), trigger edge top segment 111*a* initially moves without moving the trigger 110. As the lost motion is removed, the two components touch each other at lateral trigger segment 111*b*, and then begin to move as a unit.

Figure 16:
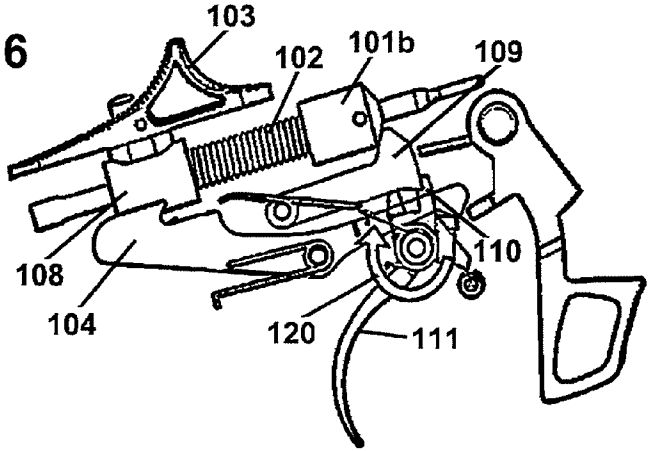
Figure 17:
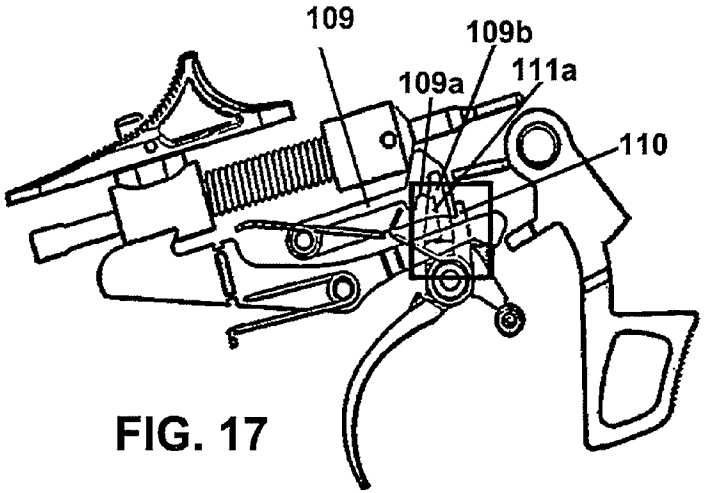
Figure 18:
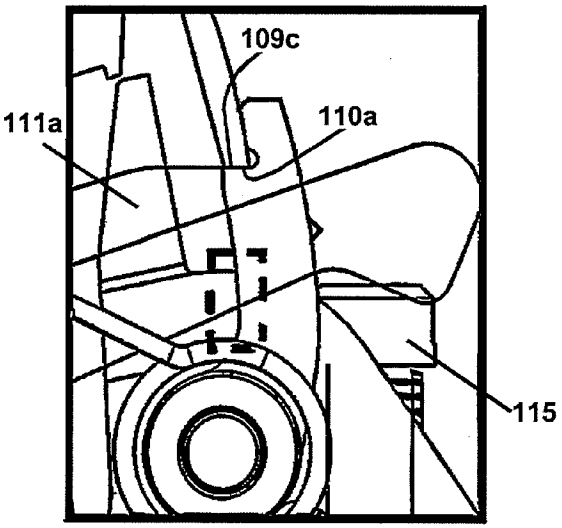

FIGS. 16, 17 and 18 show further sequential positions of the inline hammerless percussion firing system as the rifle is being fired. In FIG. 16, pressure is applied by the shooter's finger to the trigger edge to fire the rifle, and trigger edge 111 moves in the direction of arrow 120. The trigger edge spring preferably applies about 300 grams of force that must be overcome to move the trigger edge.

In FIGS. 17 and 18 it can be seen that the upper end or top segment 111*a* of the trigger edge has moved out from below a safety notch 109*a* in the sear 109 and forward below a firing notch 109*b* in the sear 109. Until the upper end 111*a* of the trigger edge has moved below firing notch 109*b* in sear 109, the sear cannot come down to release the striker and firing pin.

FIGS. 17 and 18 show the point at which the trigger edge has taken up all lost motion relative to the trigger and has just begun to touch the trigger, but the trigger has not yet begun to move. In FIG. 17 the bottom end of the trigger edge has moved to the rear and the upper end of the trigger edge has moved forward out of the safe position as finger pressure is applied to the bottom end of the trigger edge to fire the rifle.

Box 115 of FIG. 18 depicts the point of contact between trigger 110 and lateral trigger segment 111*b*. FIGS. 17 and 18 also show how the sear is being held up by the trigger 110, not the trigger edge top segment 111*a*. Trigger 110 includes a rearward facing shelf 110*a*. The forward lower edge 109*c* of the sear 109 sits on this shelf. As long as shelf 110*a* of trigger 110 holds the sear up into blocking engagement with the forward enlarged end of the striker 101*b*, the striker cannot move forward.

Figure 19:
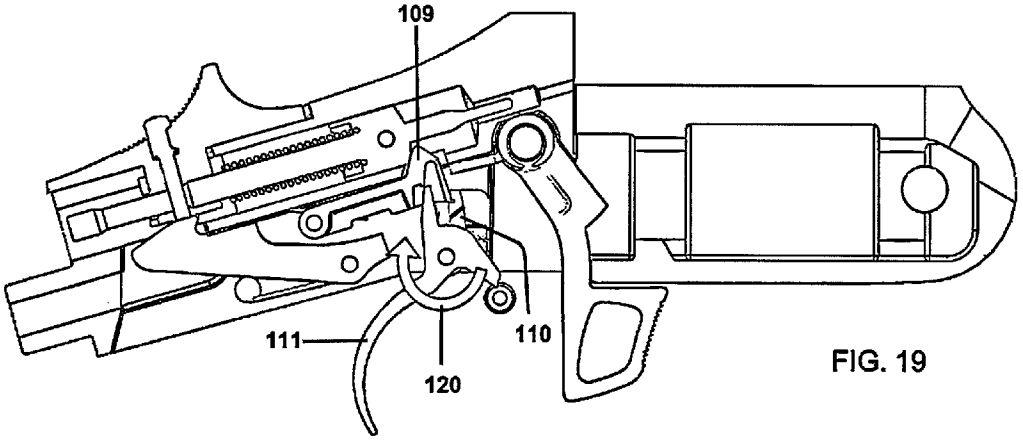
Figure 20:
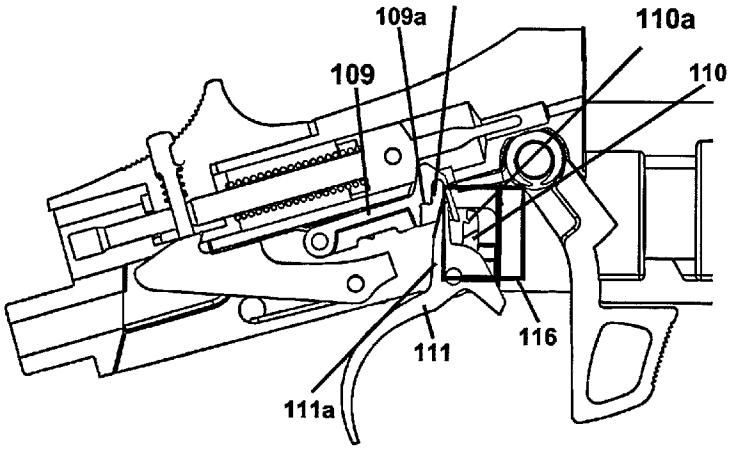
Figure 21:
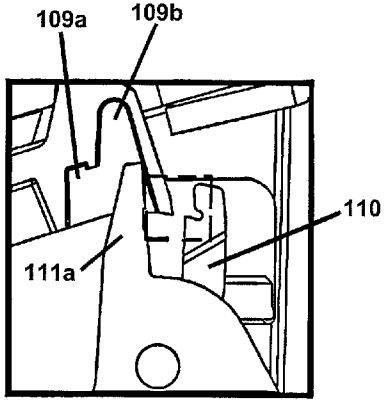

FIGS. 19, 20, and 21 show additional sequential positions of the inline hammerless percussion firing system. FIG. 19 substantially corresponds to FIGS. 17 and 18. As indicated by direction arrow 120, in FIG. 19 trigger edge 111 is moving in the direction to rotate the trigger 110 to release the sear 109 and fire the rifle. In FIG. 20, top segment 111*a* of trigger edge 111 has moved into firing notch 109*b* of sear 109. This action releases the sear to drop off shelf 110*a* at the back of trigger 110. In this position, top segment 111*a* of the trigger edge 111 has moved past safety notch 109*a* of sear 109 and below firing notch 109*b* in the sear to allow sear 109 to move down and release the striker. FIG. 21 is an expanded view of detail box 116 of FIG. 20.

Figure 22:
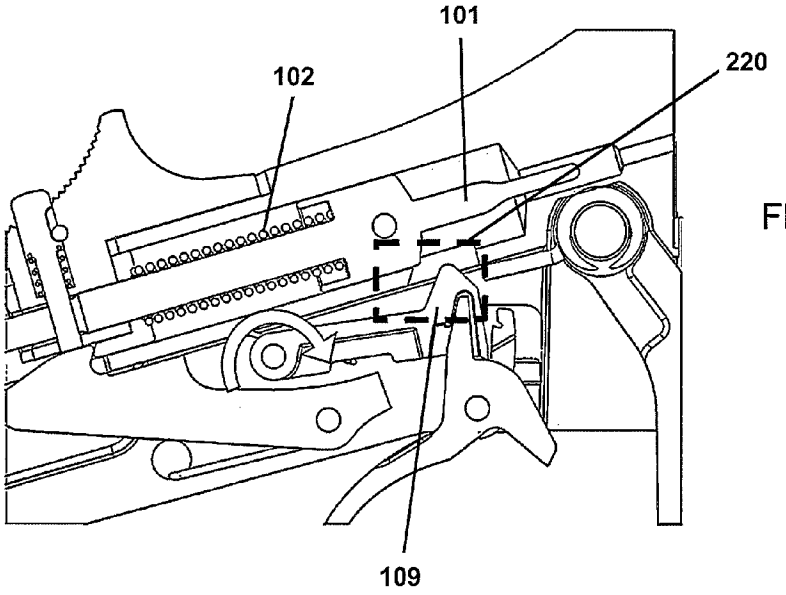
Figure 23:
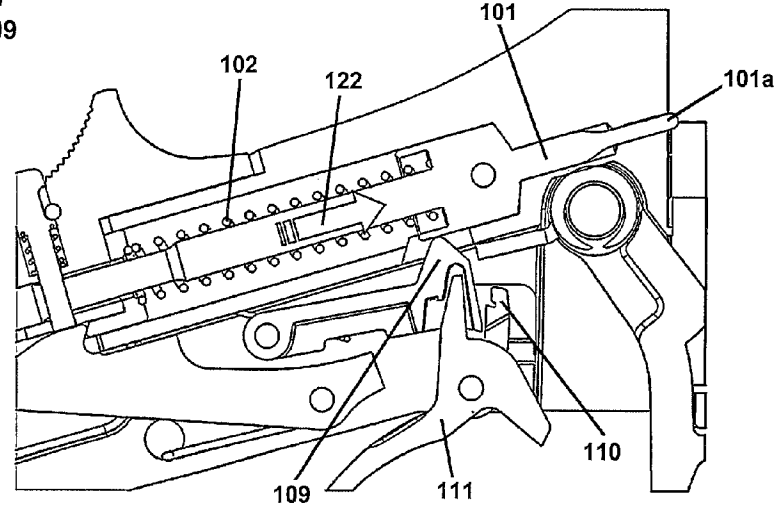

FIGS. 22 and 23 show subsequent sequential positions of the inline hammerless percussion firing system. In FIG. 22, as indicated in box 220, sear 109 is forced down, which in turn moves striker 101 forward under the pressure applied by striker spring 102. In FIG. 23, striker 101 has been driven fully forward in the direction of arrow 122. The firing pin 101*a* on the forward tip of the striker 101 has moved linearly forward and has impacted a primer (not shown) to fire the rifle. For typical muzzleloader firearm dimensions, the striker will have moved approximately 1 to 1.3 millimeters forward defining the percussion length.

Figure 24:
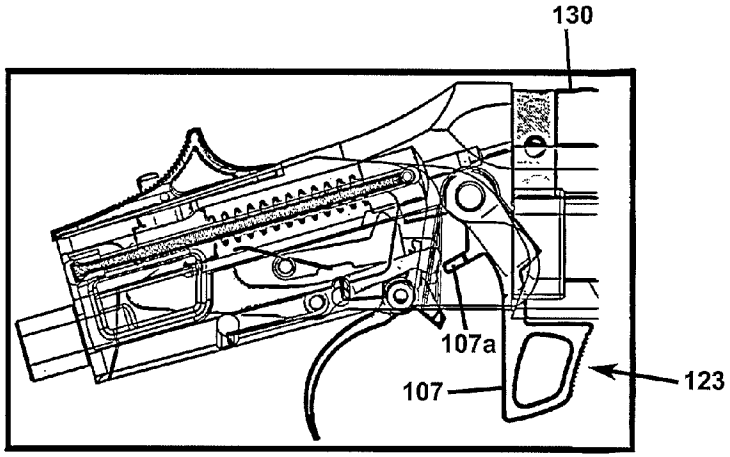
Figure 26:
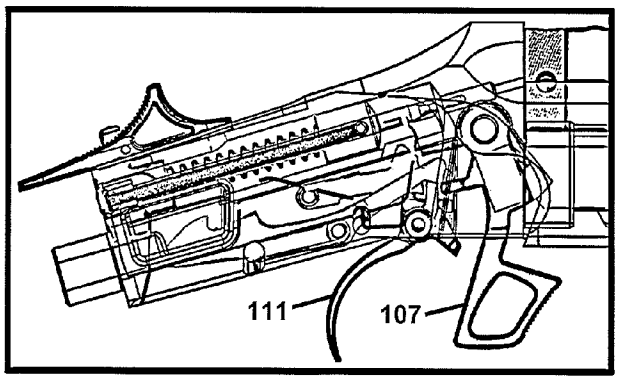
Figure 25:
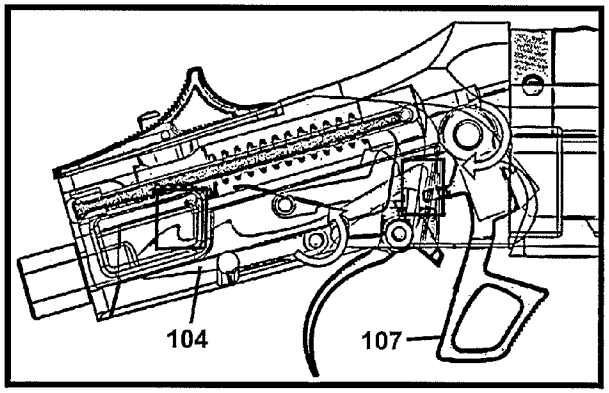

After the rifle has been fired, the barrel may then be opened and the primer removed. This action is depicted in FIGS. 24, 25, and 26. In FIG. 24, arrow 123 indicates how pressure is applied against the barrel catch 107 to release the barrel 130. In FIG. 25, barrel catch 107 has moved to the rear to release the barrel. The barrel catch 107 includes a rearward projection 107*a* that contacts the front of the retainer 104 and tilts it up. The back of retainer 104 tilts down, which releases the back of striker 101 from engagement with the nut piece 108 on the bottom end of the cocking button. In FIG. 25 the striker is still forward, but the back of the striker has been released from engagement with the nut piece 108 on the bottom end of the cocking button. In FIG. 26 the striker has moved to the rear and the mechanism has returned to the initial position shown in FIG. 10.

FIGS. 27 and 28 show sequential positions of the inline hammerless percussion firing system when the striker 101 has been cocked and is ready to fire, but it is not desired to fire the rifle. In FIG. 27 striker spring 102 is compressed and this compression must be released. To release striker spring 102, pressure is applied against the uncocking button 105. The bottom end 105*a* of the uncocking button 105 contacts the retainer 104 and pushes it down. FIG. 28 shows how the retainer has been moved down by the uncocking button 105 to release the striker 101 to move to the rear so that the striker spring 102 is no longer compressed. The rifle is now in the safe initial position of FIG. 10.

The cylindrical nut piece 108 is preferably provided with a hooking tooth engaged by the retainer. When the cylindrical nut piece 108 is disengaged from the retainer, by pressing the uncocking button 105, the striker is driven back by the antagonist spring 106, seen best in FIG. 10.

Figure 29:
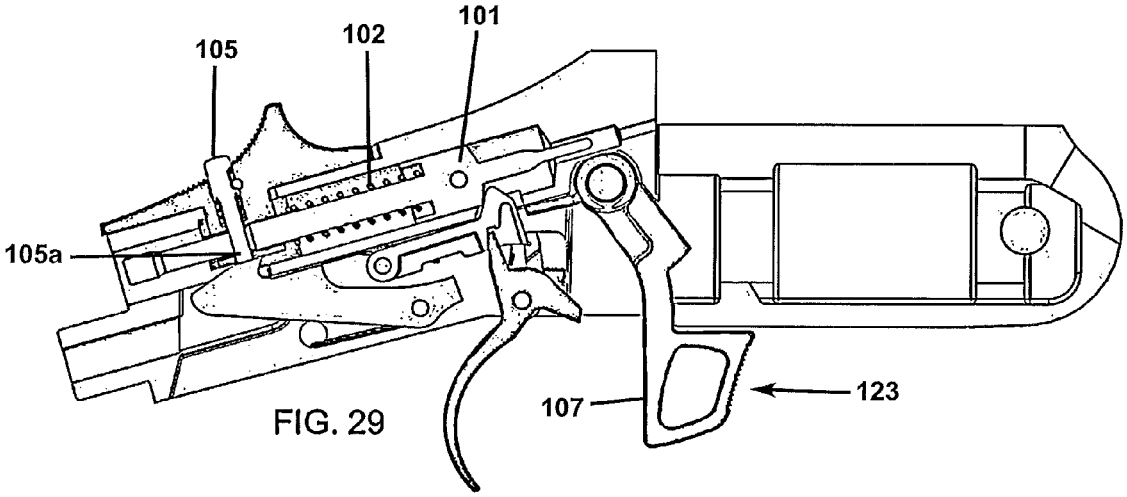
Figure 30:
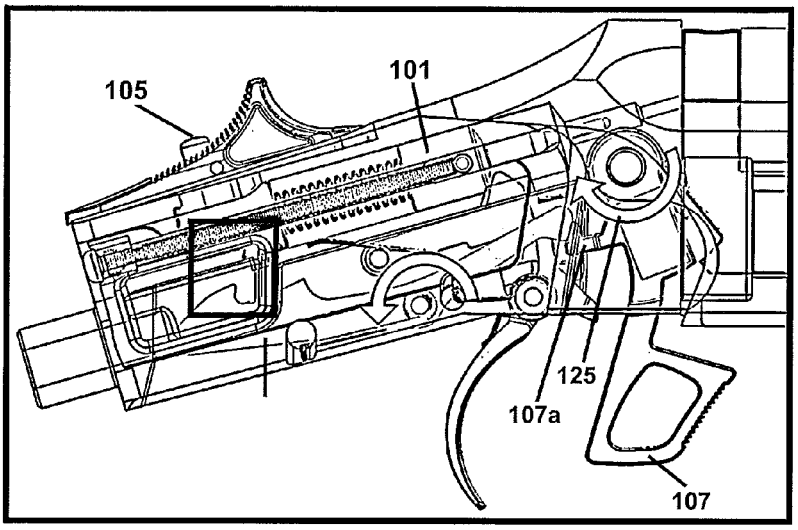

FIGS. 29 and 30 show sequential positions of the emergency uncocking system for the inline hammerless percussion firing system. Emergency uncocking occurs when the striker has been cocked and is ready to fire, and barrel catch 107 is then pressed. In FIG. 29, striker spring 102 is compressed and the rifle is ready to be fired. An arrow indicates how pressure may be applied against the barrel catch. In FIG. 30, barrel catch 107 has moved to the rear, rotating in the direction of arrow 125. As previously described, barrel catch 107 includes a rearward projection 107*a* that contacts the front of the retainer 104 and tilts it up. This causes the back of retainer 104 to tilt down, which releases the back of striker 101 from engagement with the bottom end 105*a* of the cocking button 105. The rifle then returns to the initial safe position of FIG. 10.

If a rifle is cocked and ready to fire, there is always concern that it may inadvertently discharge if dropped. FIGS. 31, 32, 33, and 34 show how the antidrop safety system functions to prevent such impact-induced accidental discharges.

Figure 31:
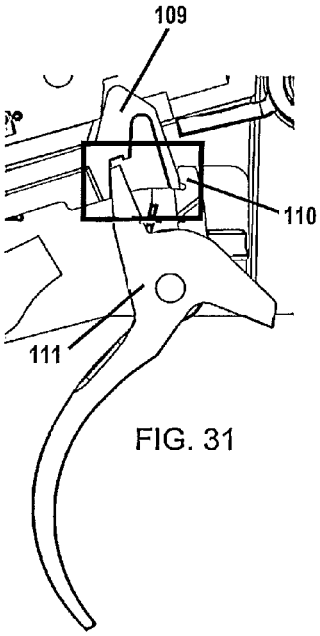
Figure 32:
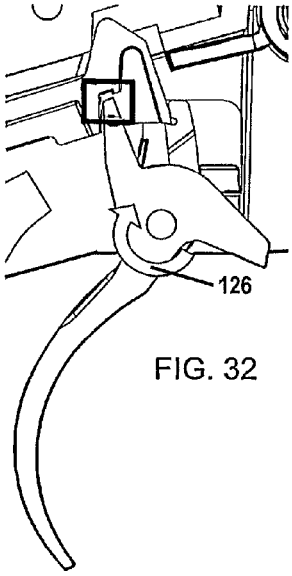
Figure 33:
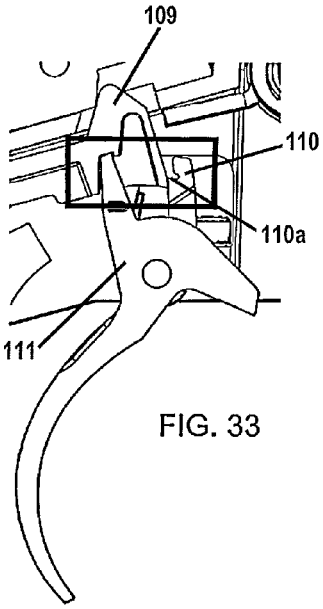

In FIG. 31 the striker spring is compressed and the rifle is ready to fire. Trigger edge 111 has not been pressed by the shooter's finger. Trigger 110 holds sear 109 in an upward, locked position. In FIG. 32 an impact occurs as the rifle is dropped with movement identified by arrow 126. In FIG. 33, trigger edge 111 has not moved because the bottom end of the trigger edge has not been pulled to the rear to intentionally fire the rifle, but trigger 110 has been moved and sear 109 has dropped off shelf 110*a* on trigger 110 by the impact.

Figure 34:
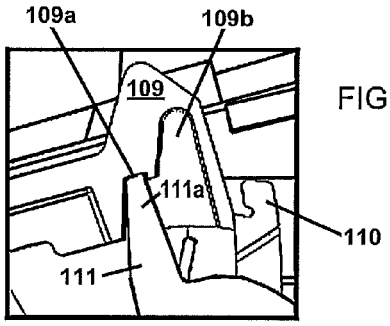

FIG. 33 shows how the sear is prevented from moving all the way down by the engagement between top segment 111*a* of trigger edge 111 and safety notch 109*a* in sear 109. This safety action takes place because top segment 111*a* of trigger edge 111 is below safety notch 109*a*, not below the firing notch 109*b* in sear 109 when the impact occurs. Accordingly, sear 109 can only move partially down, and striker 101 cannot be released to move forward. Top segment 111*a* of trigger edge 111 is preventing sear 109 from moving fully down. FIG. 34 shows this in greater detail: top segment 111*a* of trigger edge 111 is engaged with safety notch 109*a* because the trigger edge 111 was not moved to intentionally fire the rifle.

It is noted that if sear drops 109 off shelf 110*a* on trigger 110 due to impact, the rifle must be disassembled to reset the trigger and sear.

Figure 35:
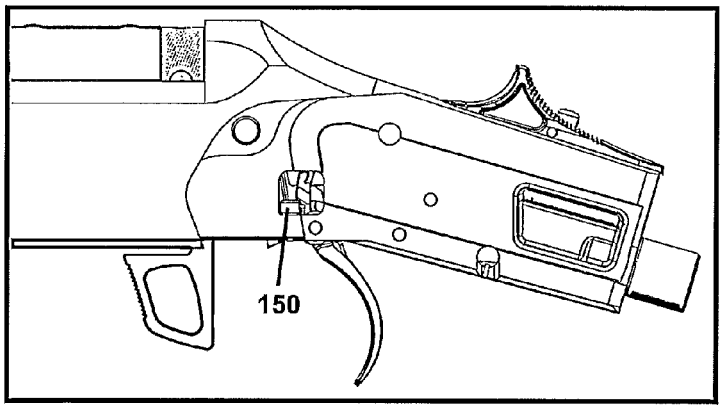
FIGS. 35, 36, and 37 show the trigger pressure regulation system of the present invention.
Figure 36:
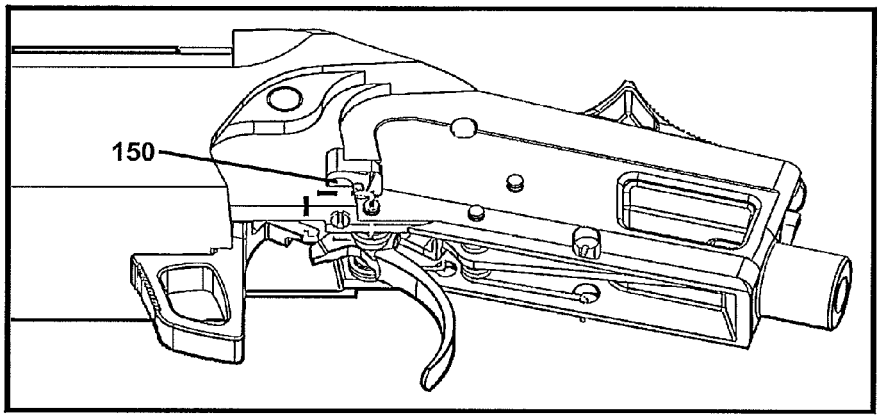
Figure 37:
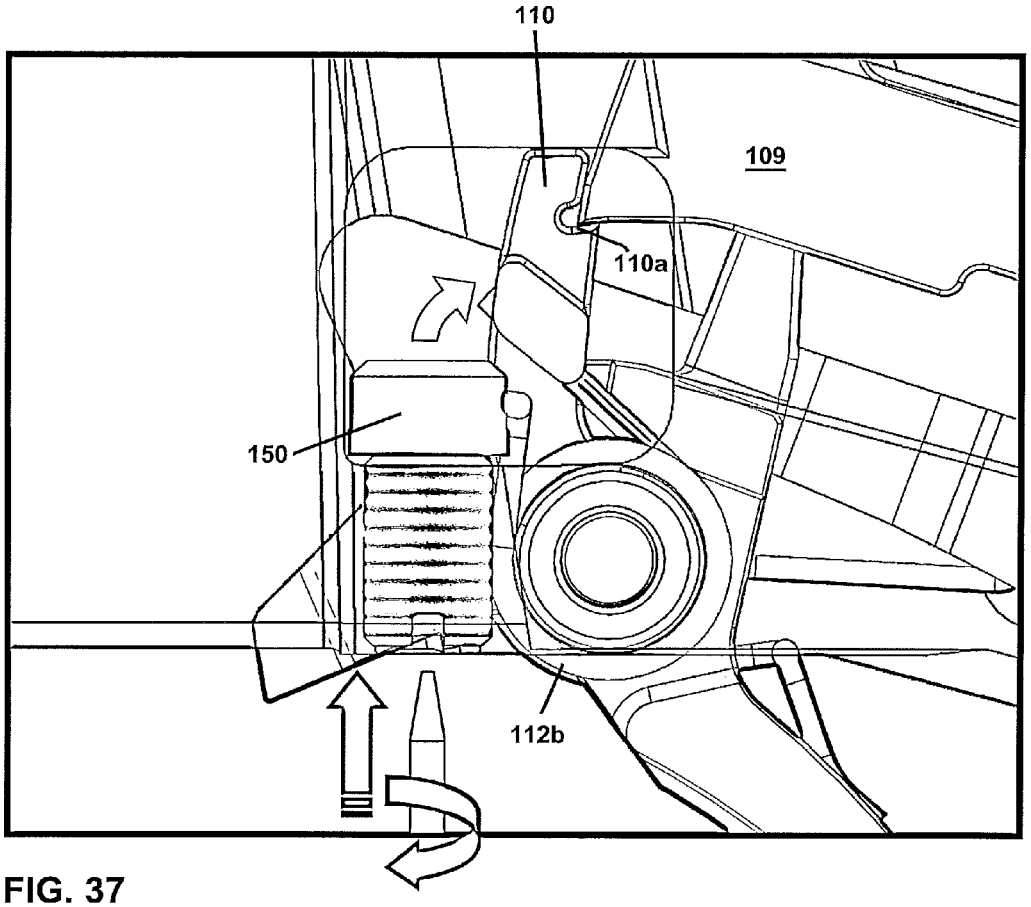

FIGS. 35, 36 and 37 show the trigger pressure regulation system of the present invention. FIGS. 35 and 36 show the position of the trigger pressure regulation screw 150. FIG. 37 is a detail view that shows how rotating trigger pressure regulation screw 150 increases or decreases the pressure applied by trigger spring 112*b* to the trigger 110. Trigger spring 112*b* holds trigger 110 against sear 109 so that the sear remains on the trigger shelf 110*a* as previously described. By adjusting trigger pressure regulation screw 150, the force required to release sear 109 from trigger 110 can be adjusted.

Figure 38:
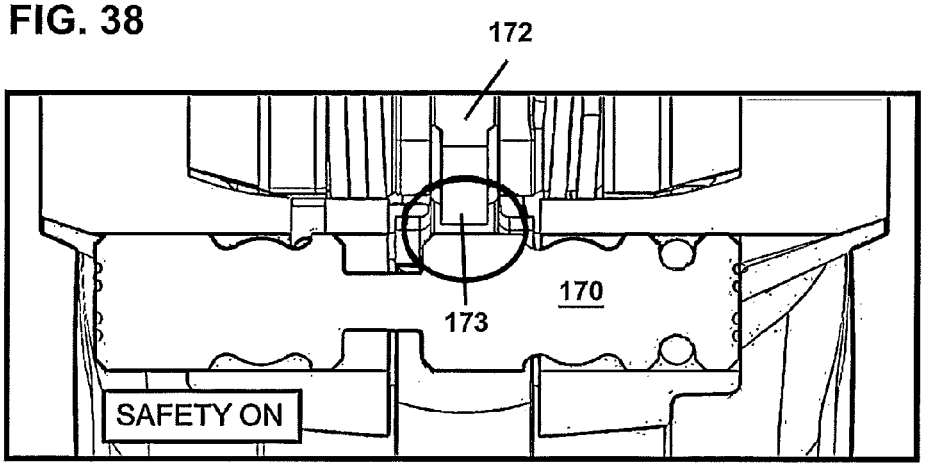
FIGS. 38, 39, and 40 depict a safety pin feature for the hammerless muzzleloader firearm of the present invention.
Figure 39:
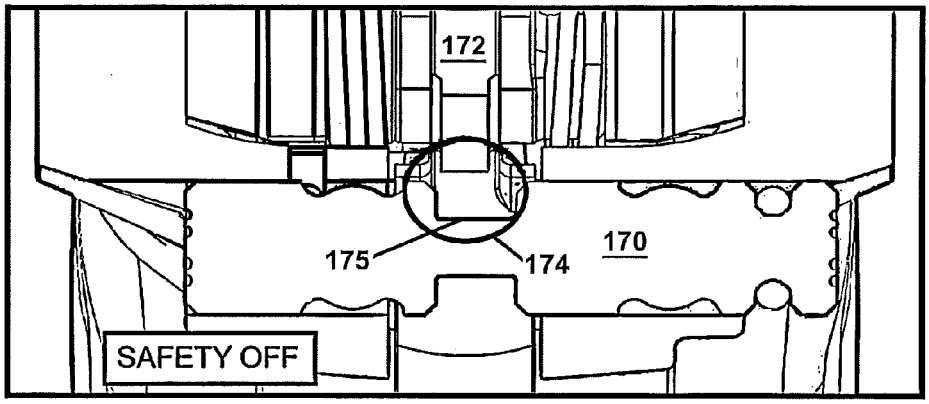
Figure 40:
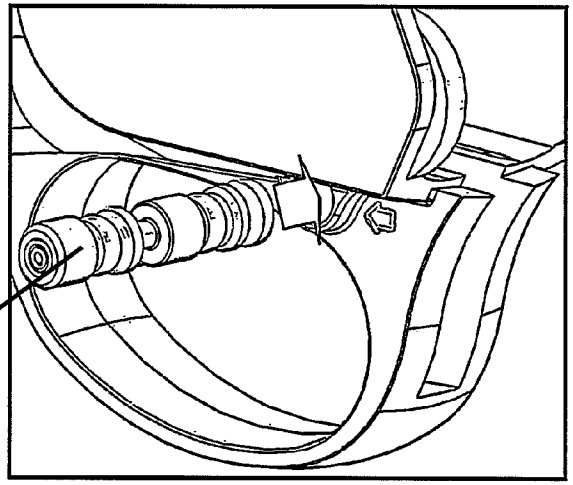
Figure 41:
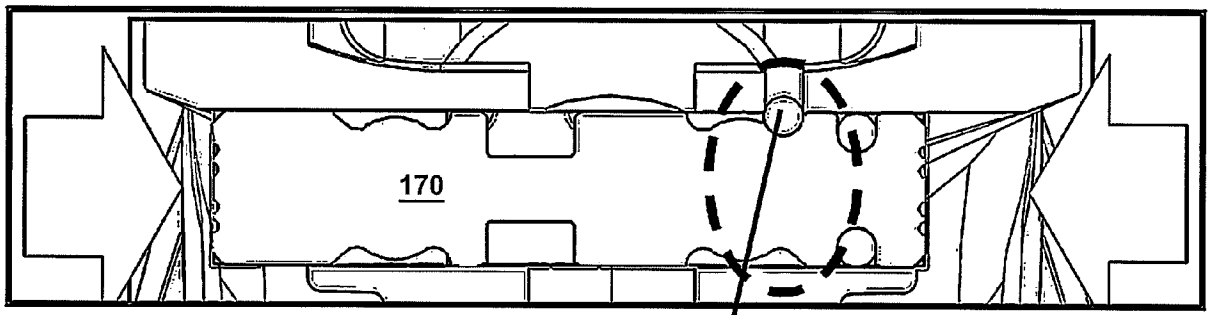
FIG. 41 depicts resilient springs associated with the safety pin giving the safety pin movement a stepped movement and position indicator.

FIGS. 38, 39, and 40 depict a safety pin 170 for the hammerless muzzleloader firearm of the present invention. Safety pin 170 is a cylindrical rod with various gaps and curvatures on its outer surface. A center gap 175 is radially deep enough to receive pin 172 which allows for firing. FIG. 38 demonstrates the position of safety pin 170 in the SAFETY ON position, where pin 172 is blocked by side portion 173 as depicted in area 174 from further downward movement. FIG. 39 demonstrates the position of safety pin 170 in the SAFETY OFF position, aligning gap 175 with pin 172 to allow pin 172 further downward movement, as shown in area 174. FIG. 41 depicts resilient springs 176 associated with the safety pin giving the safety pin a stepped movement and presenting the user with a safety pin position indicator.

The present invention further includes a method of firing a muzzleloader firearm having an inline hammerless percussion firing system. The method essentially includes cocking the muzzleloader, and then releasing the striker. The cocking involves the steps of: sliding a cocking button from a rearward safe position to a forward firing position; compressing a striker spring acting on a striker by sliding the cocking button forward; holding the striker spring compressed at a rearward end by pivotally rotating a retainer mounted to the firearm, the retainer acting proximate the rear of the striker to hold the cocking button in the forward firing position, and maintaining compression to the striker spring; holding the striker spring compressed at a forward end by a pivotally mounted sear, the sear rotated to a blocking position, thereby maintaining compression to the striker spring and preventing the striker from moving forward to a released position, the sear including a safety notch and a firing notch deeper than the safety notch; and holding the sear in the blocking position by positioning a trigger to prevent pivotal movement of the sear.

The method step of releasing the striker includes: compressing a trigger blade to release the trigger; moving the sear from said blocking position to a release position, thereby allowing the striker to move forward upon force supplied by the compressed striker spring; and moving a firing pin by releasing the striker to move linearly forward under the striker spring force to strike a cartridge.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A muzzleloader firearm inline hammerless percussion firing system comprising:

a striker having a firing pin at a forward or breech end;

a striker spring for biasing said striker in a forward position when said striker spring is compressed;

a cocking button for compressing said striker spring;

a retainer holding said cocking button in a forward position and keeping said striker spring compressed; and a sear pivotally mounted to said firearm having an upper portion for blocking said striker until a trigger system releases a lower portion of said sear;

wherein said trigger system includes a trigger holding said sear upper portion in a blocking position and releasing said sear lower portion downwards upon movement of said trigger.

2. The muzzleloader firearm inline hammerless percussion firing system of claim 1 wherein said cocking button includes a cylindrical nut portion having a slanted outer receiving surface or tooth for mechanically securing to a complementary extending segment on said retainer, such that when said cocking button is in said forward position, said complementary extending segment on said retainer holds said cocking button cylindrical nut portion in place, keeping said striker spring compressed.

3. The muzzleloader firearm inline hammerless percussion firing system of claim 2 including an uncocking button located proximate said cocking button, said uncocking button when pressed downwards into said firearm, disengages said cylindrical nut portion from said retainer, which in turn drives said striker back by said striker spring.

4. The muzzleloader firearm inline hammerless percussion firing system of claim 1 wherein said trigger includes a rearward facing shelf, and said sear includes a forward lower edge held by said rearward facing shelf of said trigger when said sear is blocking said striker.

5. The muzzleloader firearm inline hammerless percussion firing system of claim 1 including a barrel catch having a rearward projection that, when driven rearward contacts a front end of said retainer causing said retainer to tilt about a pivot point, and tilting said retainer front end up, causing said retainer back end to tilt down releasing said striker from engagement with said cocking button.

6. The muzzleloader firearm inline hammerless percussion firing system of claim 1 including a trigger pressure regulation screw that adjusts a sear release force, such that upon rotation of said trigger pressure regulation screw, pressure applied by a trigger spring increases or decreases said sear release force.

7. A muzzleloader firearm inline hammerless percussion firing system comprising:

a striker having a firing pin at a forward or breech end;

a striker spring for biasing said striker in a forward position when said striker spring is compressed;

a cocking button for compressing said striker spring;

a retainer holding said cocking button in a forward position and keeping said striker spring compressed; and a sear pivotally mounted to said firearm for blocking said striker until a trigger system releases said sear;

wherein said trigger system includes:

a trigger holding said sear in a blocking position and releasing said sear upon movement of said trigger; and said trigger and a trigger edge, each having a planar face adjacent to one another, said trigger edge including a top segment in a same vertical plane as a trigger blade, and a lateral trigger segment seated at a lower portion of said top segment and having a width extending laterally outwards from said top segment width, and including said trigger edge planar face, said trigger blade adapted for compression by a shooter's finger, said trigger and said trigger edge being joined by a pivot pin that allows said trigger and said trigger edge to rotate in mechanical communication with one another such that said adjacent planar face of said trigger edge contacts said adjacent planar face of said trigger, thereby causing both to rotate together as a unit, said rotation controlled by tension springs, such that movement of said trigger edge against said trigger by said shooter's compression of said trigger blade is resiliently resisted by said tension springs, and said trigger edge top segment initially moves without moving said trigger establishing an initial lost motion operation.

8. The muzzleloader firearm inline hammerless percussion firing system of claim 7 wherein said trigger system includes:

said lost motion operation wherein said trigger contacts said sear to hold said sear in said blocking position, and said trigger edge pivots relative to said trigger with lost motion before contacting said trigger at said trigger edge lateral segment and moving said trigger to release said sear; and said trigger blade of said trigger edge being movable by a shooter's finger pressure to move said trigger edge top segment from below a safety notch in said sear, where firing is prevented, to below a firing notch in said sear, where firing can occur.

9. The muzzleloader firearm inline hammerless percussion firing system of claim 8 wherein said top segment of said trigger edge moves into said firing notch of said sear releasing said sear to drop off a rearward facing shelf of said trigger, such that said top segment of said trigger edge moves past said safety notch of said sear and below said firing notch of said sear to allow said sear to move down and release said striker.

10. A muzzleloader firearm inline hammerless percussion firing system comprising:

a striker having a firing pin at a forward end;

a striker spring connected to the striker to linearly drive the striker and firing pin forward;

a cocking button slidably mounted to the firearm, the cocking button being slidable from a rearward safe position to a forward firing position to compress the striker spring and cock the firearm;

a retainer pivotably mounted to the firearm to act proximate the rear of the striker to hold the cocking button forward and keep the striker spring compressed;

a sear having an upper portion and a lower portion, and pivotably mounted to the firearm being movable from a blocking position in which the striker is prevented from moving forward to a released position, the sear includes a safety notch and a firing notch deeper than the safety notch; and a lost motion trigger system including a trigger that contacts a lower portion of the sear to hold the sear in the blocking position and a trigger edge that pivots relative to the trigger with lost motion before contacting the trigger and moving the trigger to release the sear lower portion to move downwards;

the trigger edge being movable by a shooter's finger pressure to move out from below the safety notch in the sear, where firing is prevented, to below the firing notch in the sear, where firing can occur.

11. The muzzleloader firearm inline hammerless percussion firing system of claim 10 wherein said trigger system includes said trigger and a trigger edge, each having a planar face adjacent to one another, said trigger edge including: a top segment, a trigger blade, and a lateral trigger segment, said trigger top segment in a same vertical plane as said trigger blade, and said lateral trigger segment seated at a lower portion of said top segment and having a width extending laterally outwards from, and wider than, said top segment width, and including said trigger edge planar face, said trigger blade adapted for compression by a shooter's finger, said trigger and said trigger edge being joined by a pivot pin that allows said trigger and said trigger edge to rotate in mechanical communication with one another, such that said adjacent planar face of said trigger edge contacts said adjacent planar face of said trigger, thereby causing both to rotate together as a unit, said rotation controlled by tension springs, such that movement of said trigger edge against said trigger by said shooter's compression of said trigger blade is resiliently resisted by said tension springs, and said trigger edge top segment initially moves without moving said trigger establishing said lost motion.

12. The muzzleloader firearm inline hammerless percussion firing system of claim 10 wherein said cocking button includes a cylindrical nut portion having a slanted outer receiving surface or tooth for mechanically securing to a complementary extending segment on said retainer, such that when said cocking button is in said forward position, said complementary extending segment on said retainer holds said cocking button cylindrical nut portion in place, keeping said striker spring compressed.

13. The muzzleloader firearm inline hammerless percussion firing system of claim 10 including a safety pin having a contoured cylindrical outer surface with gaps and blocks in said outer surface for permitting or denying operation of said firing system, said safety pin being laterally insertable into said firearm frame, and held in place by resilient bands or springs.

14. A method of firing a muzzleloader having an inline hammerless percussion firing system comprising:

cocking said muzzleloader, said cocking including:

sliding a cocking button from a rearward safe position to a forward firing position;

compressing a striker spring acting on a striker by sliding said cocking button forward;

holding said striker spring compressed at a rearward end by pivotally rotating a retainer mounted to the firearm, said retainer acting proximate the rear of said striker to hold the cocking button in said forward firing position, and maintaining compression to said striker spring;

holding said striker spring compressed at a forward end by a pivotally mounted sear, said sear rotated to a blocking position, thereby maintaining compression to said striker spring and preventing said striker from moving forward to a released position, said sear including a safety notch and a firing notch deeper than the safety notch; and holding said sear in said blocking position by positioning a trigger having a trigger edge to prevent pivotal movement of said sear, said trigger and said trigger edge having adjacent planar surfaces;

releasing said striker, said releasing including:

compressing a trigger blade to release said trigger by moving said trigger edge from said safety notch in said sear to said firing notch;

moving said sear from said blocking position to a release position by contacting said trigger planar surface against said trigger edge planar surface and allowing said trigger and said trigger edge to rotate as one unit, thereby allowing said striker to move forward upon force supplied by said compressed striker spring; and moving a firing pin by releasing said striker to move linearly forward under said striker spring force to strike a cartridge.

15. The method of claim 14 wherein said step of compressing said trigger blade to release said trigger includes:

rotating a trigger edge in mechanical communication with said trigger through a pivot pin, said rotation controlled by tension springs, such that movement of said trigger edge against said trigger by a shooter's compression of said trigger blade is resiliently resisted by said tension springs, said trigger edge initially moving without moving said trigger, establishing a lost motion operation; and upon contact of said trigger edge with said trigger, moving said trigger away from contact with said sear, releasing said sear from said blocking position.

16. The method of claim 14 including turning a trigger pressure regulation screw to adjusts a sear release force, such that upon rotation of said trigger pressure regulation screw, pressure applied by a trigger spring increases or decreases said sear release force.

17. The method of claim 14 including releasing a safety on said firearm before said step of releasing said striker, said safety released from a safety lock position to a fire position by pushing a safety pin laterally inwards toward said firearm frame.

* * * * *